US007926673B2

(12) United States Patent
Nilsson

(10) Patent No.: US 7,926,673 B2
(45) Date of Patent: Apr. 19, 2011

(54) BEVERAGE PACKAGE CONTAINER

(75) Inventor: Erik Nilsson, Stockholm (SE)

(73) Assignee: Cubis Limited, Nicosia (CY)

( * ) Notice: Subject to any disclaimer, the term of this patent is extended or adjusted under 35 U.S.C. 154(b) by 0 days.

(21) Appl. No.: 12/293,086

(22) PCT Filed: Mar. 6, 2007

(86) PCT No.: PCT/SE2007/050126
§ 371 (c)(1),
(2), (4) Date: Oct. 7, 2008

(87) PCT Pub. No.: WO2007/108758
PCT Pub. Date: Sep. 27, 2007

(65) Prior Publication Data

US 2009/0045200 A1 Feb. 19, 2009

(30) Foreign Application Priority Data

Mar. 17, 2006 (SE) ..... 0600608

(51) Int. Cl.
*B65D 51/20* (2006.01)

(52) U.S. Cl. ..... 220/254.3; 220/258.1

(58) Field of Classification Search ..... 220/780, 220/254.3, 254.5, 214, 257.1, 258.1; 222/548, 222/552
See application file for complete search history.

(56) References Cited

U.S. PATENT DOCUMENTS

| | | | | |
|---|---|---|---|---|
| 2,571,199 | A * | 10/1951 | Butler | 222/543 |
| 3,089,622 | A * | 5/1963 | Westlake, Jr. | 222/183 |
| 4,948,003 | A * | 8/1990 | Munoz | 215/237 |
| 5,106,015 | A * | 4/1992 | Vlasaty et al. | 229/125.15 |
| 5,193,712 | A | 3/1993 | Kuppersbusch | |
| 5,551,629 | A | 9/1996 | Fujimoto | |
| 6,131,806 | A | 10/2000 | Hess, III et al. | |
| 6,761,279 | B1 * | 7/2004 | Martin et al. | 220/258.2 |

FOREIGN PATENT DOCUMENTS

| | | |
|---|---|---|
| JP | 5-310266 A | 11/1993 |
| WO | 2005/075302 A1 | 8/2005 |
| WO | 2005/075303 A1 | 8/2005 |

* cited by examiner

*Primary Examiner* — Anthony Stashick
*Assistant Examiner* — James N Smalley
(74) *Attorney, Agent, or Firm* — Young & Thompson

(57) ABSTRACT

Beverage package container includes an opening, which is resealable using a sealing device, where the package container is essentially or completely parallelepipedic, including a hollow, box-shaped body and the sealing device, where a corner of the parallelepipedic, hollow, box-shaped body is chamfered, at which corner a triangular surface is formed, connecting to the box-shaped body, where a tube-shaped part extends out from the surface, including the opening. The sealing device has an essentially pyramid-shaped body, designed so that it, together with the body, forms the parallelepipedic package container when it bears on the triangular surface of the box-shaped body, and a cavity for receiving the tube-shaped part, and where cooperating members are arranged, on the tube-shaped part as well as in the cavity, for removably and tight-fittingly detaining the sealing device at the tube-shaped part, so that the box-shaped body and the sealing device together form a parallelepiped.

11 Claims, 3 Drawing Sheets

BEVERAGE PACKAGE CONTAINER

BACKGROUND OF THE INVENTION

The present invention relates to a beverage package container.

DESCRIPTION OF THE RELATED ART

In society of today, people consume many different types of beverages, for example carbonated beverages, juices, milk, milk drinks, but also beer and wine, from package containers, such as portion packs.

Today, the bottle is one of the most common containers for beverages, which is found in various sizes, and with its characteristic design, i.e. a cylindrical container tapered at the top to an opening to drink from, where the opening either is resealable, by the use of for example a screw cork, or is not resealable once opened, such as is the case when using for example a non-resealable cap. Commonly used materials for bottles are plastic, such as PET, and glass.

Another common type of package container is the aluminium can, a stackable, cylindrical package with a characteristic design for opening the can, where a piece of the aluminium is broken away from the upper side of the can, thereby creating a hole from which to drink.

Yet another common type of package is the Tetra Pak type package, onto one of the two largest side surfaces of which a straw, coated in plastic, is glued. Upon consumption, this straw is removed from the package, and is stuck down through a hole covered by aluminium foil, arranged on the upper surface of the package. Thereafter, the user can drink from the package using the straw.

The Swedish patents with numbers 0400217-6 and 0400218-4 disclose two additional types of packages, both cubic and stackable. Furthermore, these packages are resealable.

All known package types are impaired by certain disadvantages.

One problem is that packages are often transported over long distances, for example in large freight vehicles. The cylindrical beverage package container type of beverage package containers prevents an optimal utilization of the freight volume of such vehicles. The common PET bottle is usually put in bottle crates, which are thereafter steadily stacked one on top of another. This means that large volumes surrounding the bottles, as well as above and below every respective bottle, will remain unutilized during transport. Thus, this problem also exists, by way of example, for all other types of cylindrical package containers.

Another problem with many package containers is that they are not resealable. When the package container once has been opened, at a certain occasion for consumption of its contents, the person who will consume the beverage is usually forced to either empty the package from its contents at once, or to throw away any remaining beverage which is not wanted for consumption at the same time that the package was opened. On the contrary, usually the user wishes to drink a little but often, and hence to be able to reseal the package for later consumption. One solution to this problem exists in the bottle with a screw cork, for example the PET bottle, but, as described above, these bottles are associated with less than effective freight characteristics. Other common packages intended for drinking from, such as the aluminium can, glass bottle with a capsule lid or Tetra Pak container, are generally non-resealable.

The cubical types of package containers disclosed in Swedish patents with numbers 0400217-6 and 0400218-4 are on the one hand freight effective and resealable, but on the other hand they are associated with the additional problem of not being suitable for being filled completely with beverage during manufacturing. It is true that such a complete filling is possible during manufacture, but when the final user is to open the package, for consuming the beverage, some of the beverage in the container is easily spilt if the user does not direct the package seal straight upwards during the opening. In the case 0400217-6, this is because the drinking opening arranged in the sealing device is arranged below the liquid surface in the container when fully filled; In the case 0400218-4, this is, correspondingly, because the corresponding drinking opening during the opening operation at times will be positioned below the liquid surface inside the container. With the prior container according to 0400218-4, it is also not possible to supply the package container, which comprises a box-shaped body and a sealing part, with an easily accessible, inner, hygienic seal. This is a problem, since such a seal increases the hygienic security of the user when using a package container subjected to external pollution during transport, storage and other handling.

SUMMARY OF THE INVENTION

Thus, it would be desirable to achieve a package container which not only is freight effective with respect to its external geometry, and resealable, but which is also possible to fill up completely during manufacture without the user risking spilling part of the contained beverage when opening the package, and which can be furnished with an easily accessible, inner, hygienic seal.

The present invention accomplishes such a package container.

Thus, the present invention relates to a beverage package container for liquid, in which an opening is arranged, which opening is resealable using a sealing device, where the package container is essentially or completely parallelepipedic, comprising a hollow, box-shaped body and the sealing device, where a corner of the parallelepipedic, hollow, box-shaped body is chamfered, at which corner a triangular surface is formed, connecting to the box-shaped body, where a tube-shaped part extends out from the surface, comprising the opening, where the sealing device comprises an essentially pyramid-shaped body, designed so that it, together with the body, forms the parallelepipedic package container when it bears on the triangular surface of the box-shaped body, and a cavity for receiving the tube-shaped part, and where cooperating fastening means are arranged, on the tube-shaped part as well as in the cavity, for removably and tight-fittingly detaining the sealing device on the tube-shaped part, so that the box-shaped body and the sealing device together form a parallelepiped.

The invention is characterized in that the sealing device has an opening on one of its sides, opening into the cavity, in that an openable and resealable door is arranged to be able to seal the opening, and in that the tube-shaped part comprises an inner, tight-fitting sealing capsule.

BRIEF DESCRIPTION OF THE DRAWINGS

In the following, the invention will be explained in closer detail, partly in connection with exemplifying embodiments of the invention, and with reference to the accompanying drawings, in which.

DESCRIPTION OF THE PREFERRED EMBODIMENTS

Figure 1:
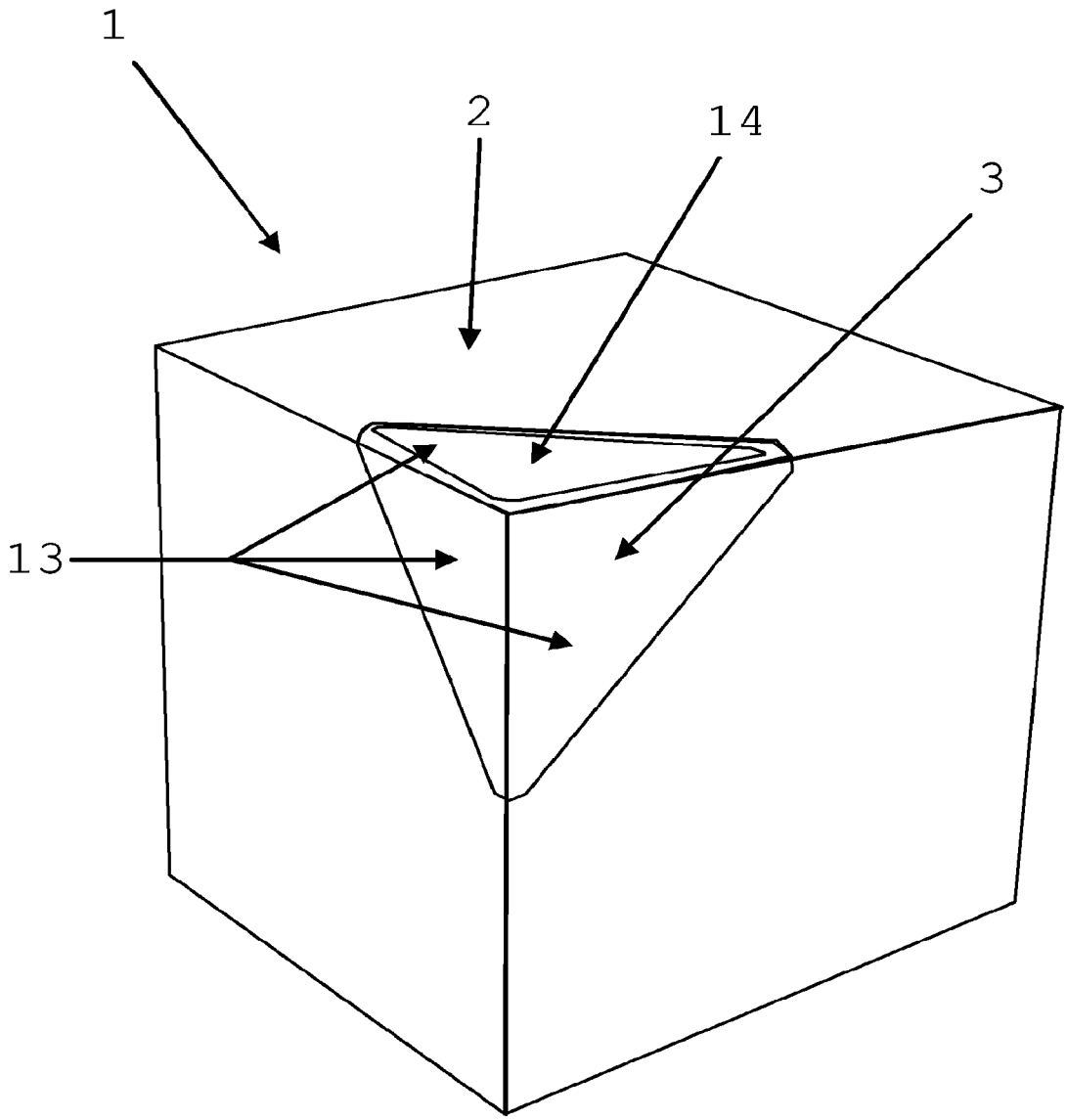
FIG. 1 is a schematic overview, showing the package container according to a preferred embodiment of the invention, with the sealing device bearing on the box-shaped body.

FIG. 1 illustrates a beverage package container 1 for liquid, in which an opening 5 (see FIG. 2) is arranged in the box-shaped body 2, which opening 5 is resealable with the use of a sealing device 3.

According to the invention, the package 1 is essentially or completely parallelepipedic, comprising a hollow, box-shaped body 2 and the sealing device 3. One of the corners of the parallelepipedic, hollow, box-shaped body 2 is chamfered, at which a triangular surface 9 (see FIG. 2) is formed. The triangular surface 9 connects to said box-shaped body 2. The sealing device 3 comprises an essentially pyramid-formed body, designed so that it forms the parallelepipedic package container 1 together with the box-shaped body 2 when the sealing device 3 bears on the triangular surface 9 at the chamfered corner of the box-shaped body 2. The parallelepipedic container 1 can be designed with bevelled corners or other aesthetic modifications, such as with surfaces that are not completely even, under condition that such aesthetic modifications do not render it impossible to reach the purpose of accomplishing improved transport efficiency according to the invention.

Figure 2:
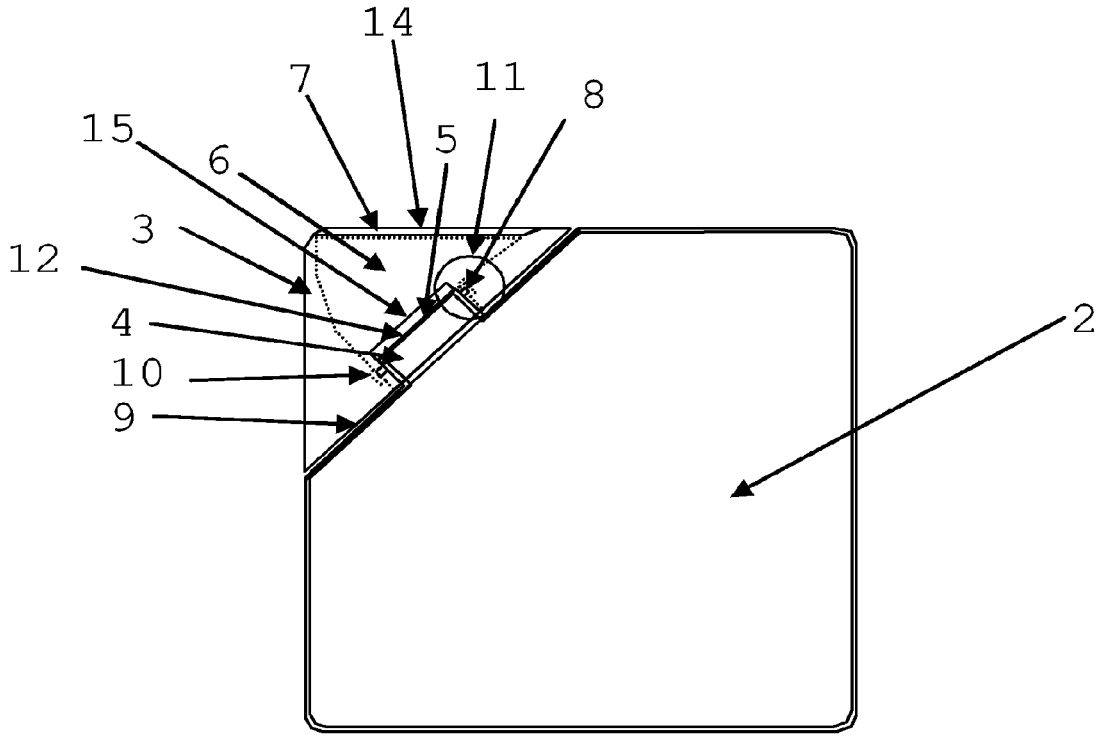
FIG. 2 is a cross-sectional view, showing a preferred embodiment of the package container according to the invention.

In FIG. 2, the package container 1 is shown in cross-section, where the container 1 is shown in a position in which the sealing device 3 is fastened on the box-shaped body 2 using cooperative fastening means 11. The cooperative fastening means 11 are arranged in part on a tube-shaped part 4, in part inside the cavity 6, and are arranged to detain the sealing device 3 on the tube-shaped part 4, so that the box-shaped body 2 and the sealing device 3 form the parallelepipedic package 1.

The projecting, tube-shaped part 4, comprising an opening 5 and a top surface 12, is arranged on the triangular surface 9. The sealing device 3 has a cavity 6, which is designed to receive the tube-shaped part 4. The cavity 6 runs through the sealing device 3, out to one of the external surfaces 13 of the sealing device 3, up to an opening 7. The opening 7 can be opened and resealed by the use of a door 14. Compare FIG. 2 to FIG. 4. In the embodiment shown in FIG. 1, the door 14 covers most of one of the sides 13 of the sealing device 3. However, it should be realized that the door 14 can be designed in other ways without departing from the inventive idea. For example, the door 14 can extend up to the corner of the sealing device 3 facing away from the box-shaped body 2, then over the corner and down a certain distance along the surfaces 13 along which the opening 7 is not arranged, in order to further increase the hygiene during transport and storage of the package 1.

The top and bottom sides, respectively, of the package container 1, or the sides of the package container 1, are defined in FIG. 1. The box-shaped body 2 is in FIG. 1 standing on its bottom side. The opposite side is the top side of the package 1. The chamfered corner of the box-shaped body 2 is arranged at one of the top corners of the body 2. In other words, the sealing device 3 is arranged at one of the corners of the body 2 which is in contact with the top side of the body 2. The opening 7 of the sealing device 3 is arranged on the top side of the sealing device 3.

The tube-shaped part 4 is arranged to tight-fittingly be fastened to the box-shaped body 2, so that no liquid nor any gas can stream into, or out of, the box-shaped body 2, except from through the tube-shaped part 4.

Furthermore, the fastening means 11 are arranged to tight-fittingly detain the sealing device 3 at the tube-shaped part 4, so that no liquid nor any gas can stream into, or out of, the box-shaped body 2 when the sealing device 3 bears on the box-shaped body 2, except from through the channel which is formed by the combination of the tube-shaped part 4 and the cavity 6 of the sealing device 3, and which thus runs from the interior of the box-shaped body 2 up to the opening 7.

In one embodiment, the fastening means 11 consists of a gas- and liquid proof snap lock. Preferably, the snap lock consists of a ridge 8 externally arranged on the tube-shaped part 4, and a recess 10 interiorly arranged in the cavity 6 of the sealing device 3.

In another embodiment (not shown), the fastening means 11 consist of gas- and liquid proof, cooperating threads, where the tube-shaped part 4 is equipped with external threads and the cavity 6 of the sealing device 3 is equipped with internal threads, where the respective threads are arranged to engage tight-fittingly.

On the top surface 12 of the tube-shaped part 4, a removable, disposable capsule 15 is arranged, which in a gas- and liquid proof manner seals the tube-shaped part 4, and thereby also the box-shaped body 2. Thus, when the package container 1 is in its sealed position, in which the capsule 15 remains on the tube-shaped part 4 and the sealing device 3 is fastened on the box-shaped part 2, gas and liquid cannot stream into nor out of the interior of the box-shaped body 2. The capsule can be removed through the openable door 14 in the sealing device 3. Once the capsule 15 has been removed, liquid can stream out of the tube-shaped part 4 and into the cavity 6 of the sealing device 3. However, as a consequence of the gas- and liquid proof fastening means 11 between the tube-shaped part 4 and the sealing device 3, liquid can not get out of the sealing device 3, as long as the package 1 is held in an upright position. Also, no liquid will pour out of the cavity 6, through the opening 7, since this is arranged at a higher position than the original level of the liquid surface inside the package container 1 when the package 1 is held upright.

Preferably, the door 14 is arranged to enable the resealing of the sealing device 3, and thereby the package 1, in a gas- and liquid proof way. However, it is highly possible for the door 14 to be arranged to merely seal the sealing device 3 in a liquid proof way, or for the door 14 not even to provide a liquid proof seal, but only to offer protection from solid external pollutants, threatening to enter down into the cavity 6 of the sealing device 3, and, in case the capsule has been removed, possibly further down into the box-shaped body 2 of the package container 1.

In a preferred embodiment, the door 14 is further provided with a sanitary, non-resealable seal (not shown). In this case, when using the package 1, the user must first remove the sanitary seal, whereby the capsule 15 can be removed and the liquid consequently consumed according to the above said. The sanitary seal is preferably gas- and liquid proof, in order to thus guarantee the hygiene inside the cavity 6 during transport and storage of the package 1.

Thus, the user opens the package 1 by first removing any sanitary seal and the door 14. Thereafter, the capsule 15 is removed, whereby contained liquid to some extent streams out of the cavity 6, but not out of the sealing device 3. Thereafter, the user can drink from the liquid, or pour the liquid out, down into for example a glass, from the opening 7. When the user has finished drinking or pouring, and wishes to save the remaining liquid for consumption at a later time, he can reseal the sealing device 3 by closing the door 14.

Figure 3:
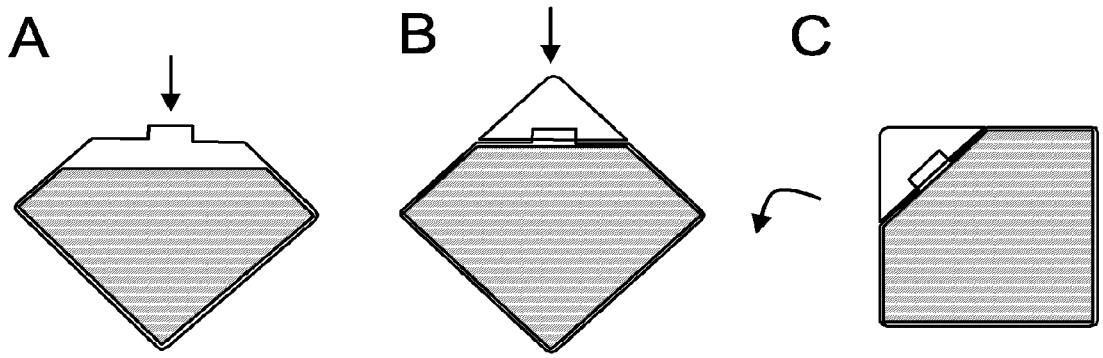
FIG. 3 is an overview illustrating the method of filling the package container according to the invention during manufacture.
Figure 4:
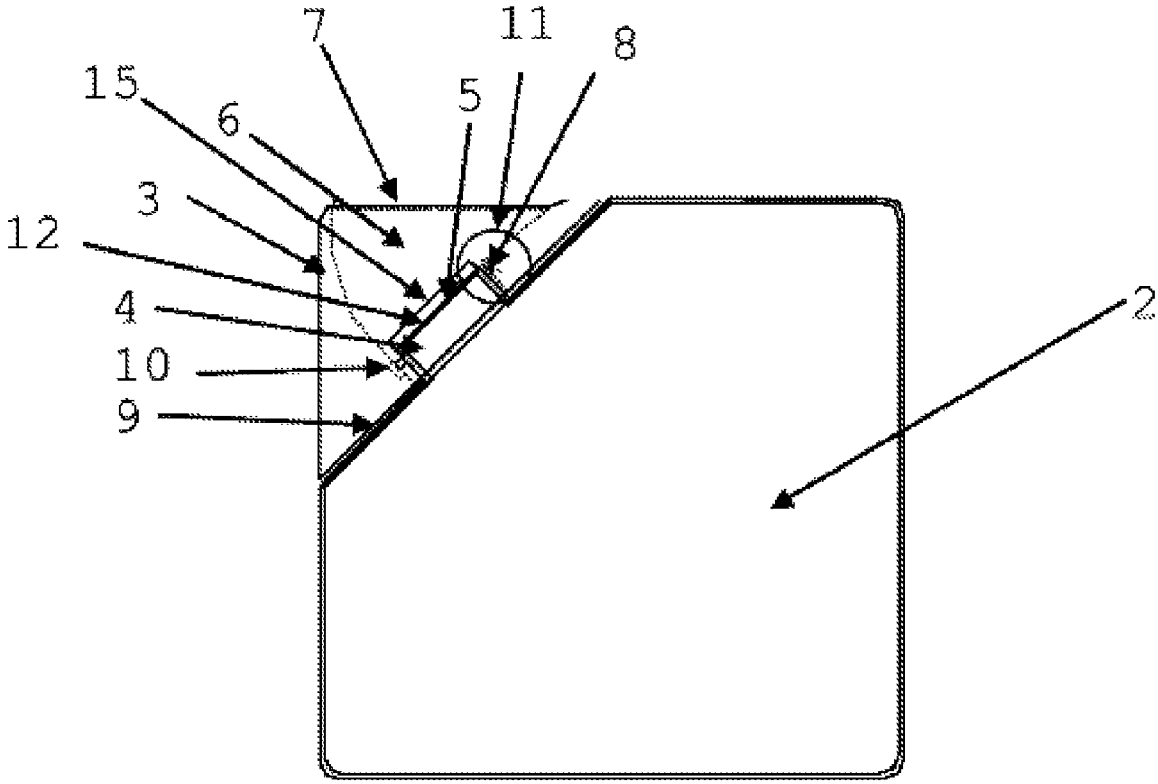
FIG. 4 is a cross-sectional view, showing a preferred embodiment of the package container according to the invention, without door 14.

FIG. 3 shows, schematically, the method for filling the package container 1, during manufacture of the same, according to the present invention.

At step A, the package 1 is filled, through the opening 5, with liquid. This is accomplished before the sealing device 3 has been attached to the package 1, and with the package 1 in a position in which the opening 5 is directed upwards, in order thus to render complete filling of the package 1, without spillage, possible.

At step B, the sealing device 3 is attached to the package container 1, using the fastening means 11. This is accomplished while the package 1 is still in the position described above, with the opening 5 directed upwards. Also, at this step, the capsule 15 is attached to the tube-shaped part 4. Furthermore, this step is finished by the attachment of the sanitary seal onto the door 14, in case such a seal is to be used.

Once the package container 1 has been filled completely, and the package 1 has been sealed in a gas- and liquid proof way, the package 1 can then, at step C, be turned so that it ends up in an upright position. This finishes the filling method when manufacturing the package container 1.

The embodiments described herein shall be regarded as exemplifying and not limiting for the invention. Thus, it is possible to vary the invention within the scope of the attached claims.

The invention claimed is:

1. Beverage package container (1) for liquid, comprising:

a hollow, box-shaped body that is an essentially or completely parallelepipedic, a corner of the body (2) being chamfered;

a triangular surface (9) formed at the corner of the body where the body is chamfered;

a sealing device (3) comprised of an essentially pyramid-shaped body defining a cavity (6) within the sealing device (3), the sealing device (3) further comprising an opening (7) located at a top side of the sealing device and opening into the cavity (6), the sealing device bearing against the triangular surface to define an overall parallelepipedic package, the sealing device completing the parallelepipedic form of the box-shaped body;

a tube-shaped part (4) extending out from the body at the triangular surface and into the cavity (6) defined by the pyramid-shaped body of the sealing device, the tube-shaped part comprising a body opening (5), the body opening (5) being resealable using the sealing device (3);

a cooperating fastening means (11) fastening the sealing device (3) on the body (2), the fastening means arranged on the tube-shaped part (4) as well as in the cavity (6), the fastening means (11) arranged to tight-fittingly detain the sealing device (3) at the tube-shaped part (4) so that no liquid can stream into, or out of, the box-shaped body (2) when the sealing device bears on the box-shaped body, except through a channel which is formed by the combination of the tube-shaped part and the cavity (6), said channel running from the interior of the box-shaped body and up to the opening (7), an openable and resealable door (14) arranged to seal the opening (7) of the sealing device (3), the door having a perimeter located entirely within an uppermost planar face of the pyramid-shaped body of the sealing device; and an inner, tight-fitting sealing capsule (15) sealing the tube-shaped part and the body (2), the sealing device (3) arranged so that no liquid can escape out from the container (1) through the opening (7) of the sealing device when the container is completely filled and placed in an upright position, and the inner capsule (15) is removed.

2. Beverage package container according to claim 1, wherein the fastening means (11) comprises a snap lock.

3. Beverage package container according to claim 1, wherein the fastening means (11) comprises threads.

4. Beverage package container according to claim 1, wherein the opening (7) is arranged for letting a user drink, or pour liquid, from the package container (1) when the door (14) is in an open position.

5. Beverage package container according to claim 1, wherein the door (14) comprises an additional sanitary, non-resealable seal.

6. Beverage package container according to claim 2, wherein the opening (7) is arranged for letting a user drink, or pour liquid, from the package container (1) when the door (14) is in an open position.

7. Beverage package container according to claim 3, wherein the opening (7) is arranged for letting a user drink, or pour liquid, from the package container (1) when the door (14) is in an open position.

8. Beverage package container according to claim 2, wherein the door (14) comprises an additional sanitary, non-resealable seal.

9. Beverage package container according to claim 3, wherein the door (14) comprises an additional sanitary, non-resealable seal.

10. Beverage package container according to claim 4, wherein the door (14) comprises an additional sanitary, non-resealable seal.

11. Beverage package container (1) for liquid, comprising:

a hollow, box-shaped body with a chamfered corner and a triangular surface (9) formed at the chamfered corner;

a sealing device (3) bearing against the triangular surface and thereby defining an overall parallelepipedic container, the sealing device completing the parallelepipedic form of the box-shaped body, the body, when sealed, being configured for containing a liquid beverage in a leak-tight manner, the sealing device (3) comprised of i) a pyramid-shaped body providing a cavity (6) within the sealing device (3), ii) an opening (7) located at a top side of the sealing device and opening the cavity (6), and iii) an openable door (14) arranged to seal and reseal the opening (7) the door having a perimeter located entirely within an uppermost planar face of the pyramid-shaped body of the sealing device;

a tube-shaped part (4) extending out from the body at the triangular surface and into the cavity (6), the tube-shaped part comprising a body opening (5), the body opening (5) being resealable using the sealing device (3) and providing a path for streaming liquid out of the tube-shape part (4);

cooperating fastening means (11) fastening the sealing device (3) on the body (2), the fastening means arranged on the tube-shaped part (4) and in the cavity (6) for removably and tight-fittingly detaining the sealing device (3) at the tube-shaped part (4) so that no liquid can stream into, or out of, the box-shaped body (2) when the sealing device bears on the box-shaped body, except through a channel which is formed by the combination of the tube-shaped part and the cavity (6), said channel running from the interior of the box-shaped body and up to the opening (7); and a sealing capsule (15) arranged on a top surface of the tube-shaped part (4) liquid sealing the tube-shaped part and the body (2), the sealing device (3) arranged so that no liquid can escape out from the container (1) through the opening (7) of the sealing device when the container is completely filled and placed in an upright position, and the sealing capsule (15) is removed.

* * * * *